US005875938A

United States Patent [19]

Graf et al.

[11] Patent Number: 5,875,938

[45] Date of Patent: Mar. 2, 1999

[54] MEDIA DISPENSER WITH MAGNETIC ELEMENT

[75] Inventors: Lothar Graf, Rielasingen-Worblingen; Stefan Ritsche, Radolfzell, both of Germany

[73] Assignee: Ing. Erich Pfeiffer GmbH, Radolfzell, Germany

[21] Appl. No.: 811,846

[22] Filed: Mar. 5, 1997

[30] Foreign Application Priority Data

Mar. 9, 1996 [DE] Germany ..... 196 09 181.0

[51] Int. Cl.[6] ..... B67D 5/40

[52] U.S. Cl. ..... 222/321.7; 222/341; 222/385

[58] Field of Search ..... 222/321.1, 321.2, 222/321.7, 321.9, 340, 341, 380, 385

[56] References Cited

U.S. PATENT DOCUMENTS

| | | | |
|---|---|---|---|
| 4,079,865 | 3/1978 | Kutik | 222/385 |
| 4,260,340 | 4/1981 | Lamaudiere | 222/385 |
| 4,261,485 | 4/1981 | Borg | 222/500 |
| 4,467,943 | 8/1984 | Carse | 222/341 |
| 4,487,340 | 12/1984 | Shaffer | 222/385 |
| 4,693,675 | 9/1987 | Venus, Jr. | 222/385 |
| 5,005,738 | 4/1991 | Tempelman | 222/402.19 |
| 5,190,192 | 3/1993 | Lina et al. | 222/321.2 |

FOREIGN PATENT DOCUMENTS 39 36 468 A1 6/1991 Germany .

OTHER PUBLICATIONS

European search report dated Jul. 2, 1997 in EPO Appl. No. 97 10 3535.

German search report dated Aug. 21, 1996 in German Appl. No. 196 09 181.0.

*Primary Examiner*—Joseph A. Kaufman

*Attorney, Agent, or Firm*—Quarles & Brady

[57] ABSTRACT

In a discharge device including two mutually shiftable units (2, 3) permanent magnets (14, 24, 33, 34) are provided for controlling a piston unit (20) and valves (13, 23, 45), the magnetic force of these magnets being provided more particularly to cause a reset movement into the starting position. These magnets may be immersed in the medium or surrounded on all sides by the medium flow, thus enabling mechanical springs to be eliminated and assuring highly reliable functioning.

27 Claims, 6 Drawing Sheets

MEDIA DISPENSER WITH MAGNETIC ELEMENT

TECHNICAL FIELD OF THE INVENTION

The invention relates to a discharge device for media such as gaseous, liquid, creamy, gel-like, powdery and/or solid media or the like which for discharging are preferably exposed to an overpressure in a pressure or pump chamber and are discharged at this pressure from the medium orifice of the discharge device, thereby totally exiting from the discharge device. In this arrangement the flowable medium may be discharged as an undispersed line of medium or as a spray or atomized spray suitable for technical, cosmetic and/or medical applications.

To open for discharging the medium or to create a pressure, the discharge device comprises two device units which can be moved relative to each other in a single hand of a user, which also simultaneously carries the discharge device. This causes the shape or length of the discharge device to change, more particularly, it becomes smaller. The device units or their base bodies may be configured integrally with each other or formed as separate items and then joined together. If the discharge delivery component is provided as a pump, such as a plunger pump, then the first discharge unit contains the pump housing including a pump cylinder and, where necessary, a fastener member for securing the discharge device to a medium reservoir. The second discharge unit contains a piston unit with an actuating head in which the medium orifice may be provided. An inlet valve which opens and closes in response to the actuating stroke is expediently provided at the first discharge unit for filling the pressure space, whilst an outlet valve for opening and closing may be provided at the second discharge unit.

Advantageously, the discharge device comprises a component for influencing the medium, for example, for separating particles; for defining closed spaces, such as medium spaces or flow paths; for exerting a retaining or latching force; or for exerting a controlling, setting, resetting, activating, closing, driving force and/or counterforce acting against the pressure of the medium, for changing the cross-section of the cited spaces or passages and/or for positionally locating the complete discharge device with respect to a counterhold. Such an influencing component may act bondingly, springingly, attenuatingly in the fashion of a latching or snap-action connection or serve similar to a spring also for preventing movement or play.

OBJECTS OF THE INVENTION

The invention provides a discharge device for media in which the drawbacks of known discharge devices are avoided and which includes, more particularly, at least one force member for exerting a useful force, said force member being configured very simply.

SUMMARY OF THE INVENTION

In accordance with the invention, the discharge device includes at least one component having ferromagnetic properties. This component may be magnetized or non-magnetized and defines, in a first case, a magnetic field having two or more opposing magnetic poles from which a magnetic field emanates. This magnetic field may exert its effects on the aforementioned component. The ferromagnetic component is more particularly arranged by being totally enclosed within the discharge device. It may contain iron or a suitable alloy or consist of a compacted polarized bulk material, the particles of which are consolidated into a rigidly dimensioned or flexible body of a plastic binding material, where necessary. This component may be freely movable as a result of the magnetic field or of the forces of gravity and as a component of an assembly in which it is loosely or firmly connected, e.g. by adhesion, embedding or the like.

The magnetic force is more particularly suited as a closing force for a valve, as a resetting force for a valve or for the device units, or as a force countering the pressure of the medium or the like. In this arrangement the ferromagnetic component may be totally surrounded by the flow of the medium or comprise at least one peripheral or similar surface area which seals off contact with the medium and which is a dry surface area. Furthermore, the magnetic force may have an axial and/or rotating effect, e.g. in the case of a setting or counting means for discharge strokes in which the two device units are incrementally and continuously rotated one against the other. The magnetic force may also, however, be used as the force that causes an increase in pressure, e.g. for moving a piston or plunger in the pump cylinder. Furthermore, the magnetic force may be employed to facilitate the assembly of the discharge device, for instance, to locate the two device units with respect to each other.

The ferromagnetic component is resistant to changes in temperature and aging and may be sterilized by simple methods. Preferably, for manufacturing the ferromagnetic component is made of a material permitting processing by injection molding and is magnetized and polarized in the production tool under the influence of a magnetic force of a solenoid. This material may contain 2% at the least, 10%–20% plastics material at the most, whilst the remainder is a magnetic powder having a grain size in the $\mu$m range. Such plastomagnets may contain, as the ferromagnetic component, an alloy, for instance, neodymium-iron-boron, the polarization of which is oriented prior to the component becoming cold or solidifying. After this production the component may be again demagnetized or neutralized by an opposing magnetic force to prevent disadvantageous effects of magnetization, for example, an undesirable attraction to other ferromagnetic component bodies prior to assembly. Directly prior to and/or after assembly the ferromagnetic component is then remagnetized or activated and thus translated into its functioning or working condition. These and further features are also evident from the description and the drawings, each of the individual features being achieved by themselves or severally in the form of subcombinations in one embodiment of the invention and in other fields and may represent advantageous aspects as well as being patentable in their own right, for which protection is sought herein.

BRIEF DESCRIPTION OF THE DRAWINGS

Example embodiments of the invention are explained in more detail in the following and illustrated in the drawings in which.

DETAILED DESCRIPTION

Figure 8:
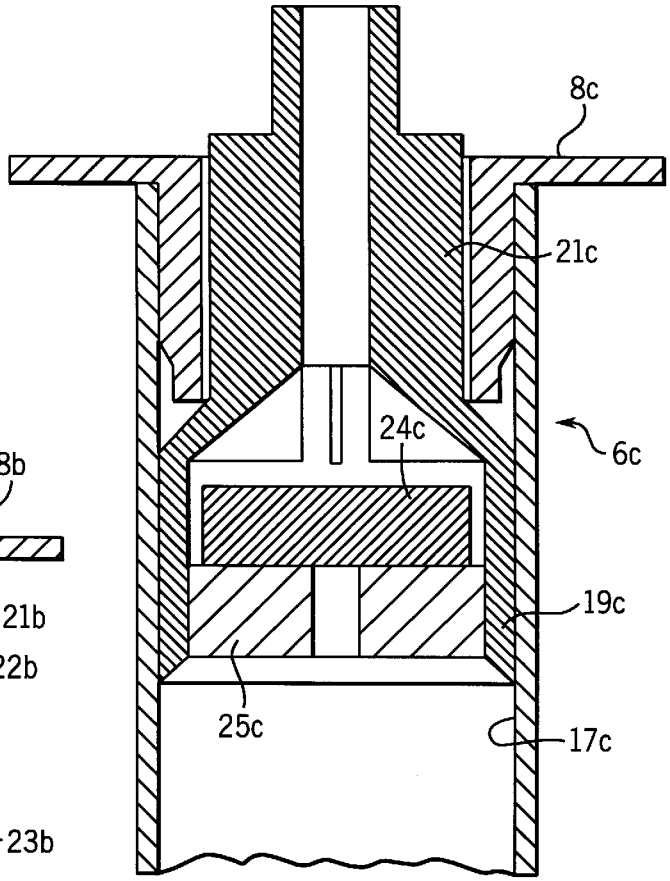
FIG. 8 is an axial section view of a variation of the second embodiment of the valve mechanism of FIG. 7.
Figure 7:
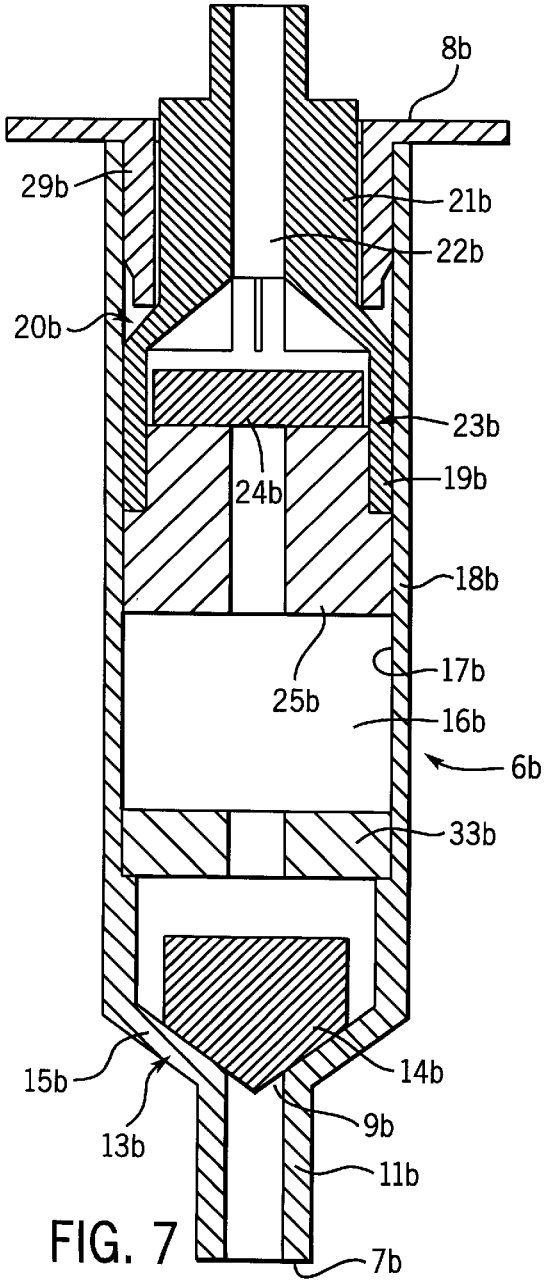
FIG. 7 is an axial section view of a second embodiment of a valve mechanism in accordance with the present invention.
Figure 9:
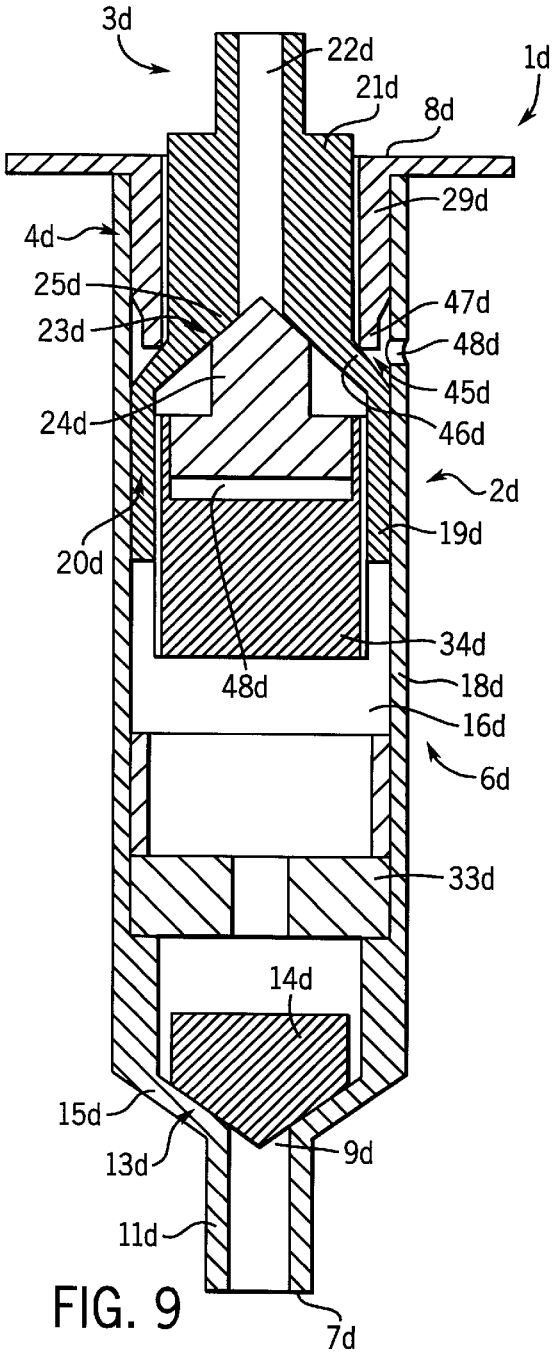
FIG. 9 is an axial section view of a third embodiment of the valve mechanism of the present invention.

The discharge device 1 comprises two mutually movable units 2,3 for manually increasing pressure on the medium, each unit having a respective base body 4, 5 which is to be linearly pushed against the other for generating the pressure. Referring to FIGS. 7 to 9, for example, the base body 4 of the unit 2 forms a tubular housing 6 having an inner end 7 and an outer end 8. The unit 2, 4 is inserted through the neck and into a reservoir vessel over the majority of its length, so that the end 7 is located in the reservoir and the end 8 is outside of the reservoir whilst the housing 6 is directly surrounded by the flow of the stored medium. Accordingly, in perpendicular orientation of the discharge device 1, with the medium orifice located at the top or with the main flow of the medium oriented upwards within the discharge device 1, "inside" is synonymous with "down" and "outside" is synonymous with "up".

In the region of the end 7, a closable inlet 9 may be located through which, on the return stroke of the device 1, medium flows from the reservoir into the housing 6 by suction. The end 7 may be defined by the closing surfaces areas of the inlet closure, the associated bottom surface area of the pressure space or the free end of a port 11 of the base body 4, 6. An inlet or riser tube 12 may have one end adjoining the port 11, which is configured substantially narrower than the housing 6. The other end of the tube 12 has a suction effect in the bottom region of the reservoir and is configured as a component either separate from the port 11 or integral with the port 11. Substantially all arrangements and components of the discharge device are located along a single longitudinal axis 10, along which the components 1 to 6 are extended and are centered.

In this case the inlet closure is formed by a valve 13 which opens and closes in response to pressure of the medium or to the settings of the units 2, 3 with respect to each other. The valve element 14, which is movable within the housing 6, comprises a conical closing surface area oriented inwards for the other valve element 15. Element 15 is configured integrally with the housing 6 as an axially annular transition of the housing shell 18 into the port 11 and thus defines the inlet 9. The outermost shell 18 of the housing 6 encloses a pressure space or pump space 16 which is bounded at the inner end by the valve 13 and at the outer end by a piston 19 of a piston unit 20 or by the closing surfaces areas of a further valve 23. The inner circumference of the shell 18 forms a runway 17 for slidable movement of the plunger or piston 19 with a seal being provided by one or several piston lips along the runway 17.

Figure 14:
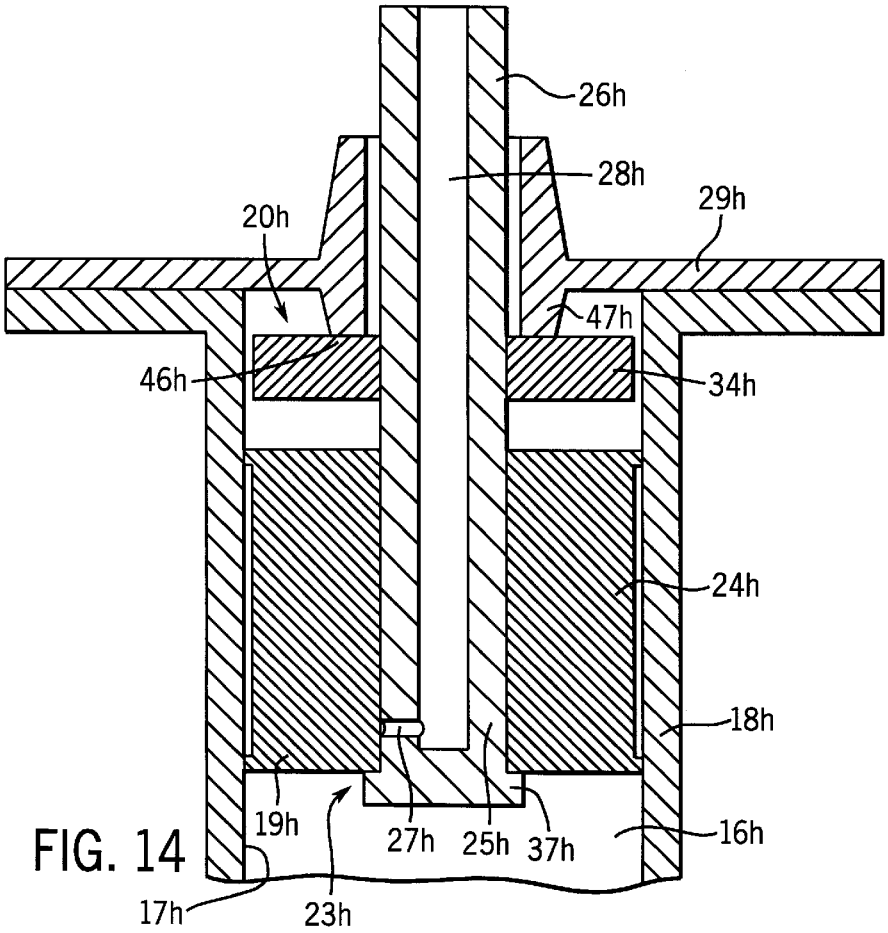
FIG. 14 is an axial section view of a further embodiment of a plunger closure.

The piston unit 20 comprises a piston neck 21 configured integrally with the dish-shaped piston 19 and constricted with respect to a longitudinal passage 22, and substantially constricted with respect to the inner circumference of the piston 19, which passes through said piston neck. The outlet valve 23 comprises, like the valve 13, two valve elements 24, 25 which move with respect to each other into an open position and a closed position. The cooperating closing surface areas of said valve elements 24, 25 are located within the piston 19 or the piston neck 21 and come up against each other in the closed position, or in accordance with FIG. 14, are a component of a plunger valve. In this case, instead of the piston neck 21 a passage shank 26 integrally containing the valve element 25 may be provided, the valve element 24 being shiftable on said passage shank 26 between two positions limited by a stop or the like. In the closed position the valve element 25 closes a transverse passage 27 in the valve element 25. The transverse passage 27 is connected to, and communicates with, a longitudinal passage 28. The outer end of the housing 6, 18 may be closed off by a separate cover 29 through which the piston unit 20, 21 passes. This closure may also be configured integrally with the shell 18.

Figure 1:
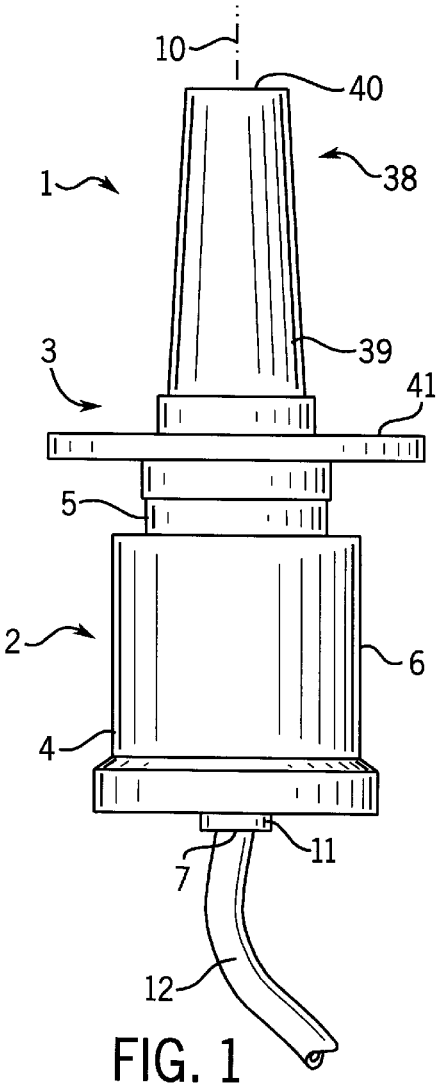
FIG. 1 is an elevational view of a discharge device in accordance with the invention.
Figure 2:
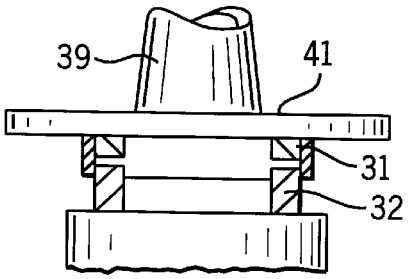
FIG. 2 is an axial section detail view of the device shown in FIG. 1.

In accordance with FIGS. 1 and 2, the two units 2, 4 and 3,5 are continuously urged back to their starting position in the return stroke direction by two components 31, 32 having ferromagnetic properties which under magnetic force repel each other. The two components 31, 32 are arranged to face each other, or to face away from each other, respectively, with the same magnetic poles. The components 31, 32 may be arranged annularly about the axis 10 at the outer side of the base body 4, 6 or 5 and have the same inner width and/or outer width. They produce a spring force which progressively increases when approaching each other, namely on the working stroke, and in the actuated end position may either come up against each other or be located away from each other by a gap or space. In this case they are provided in the region of the end 8, or of a fastener member, which serves to locate the position of the unit 2,4 on the reservoir neck and may be formed by the base body 4 or by the cover 29.

Figure 3:
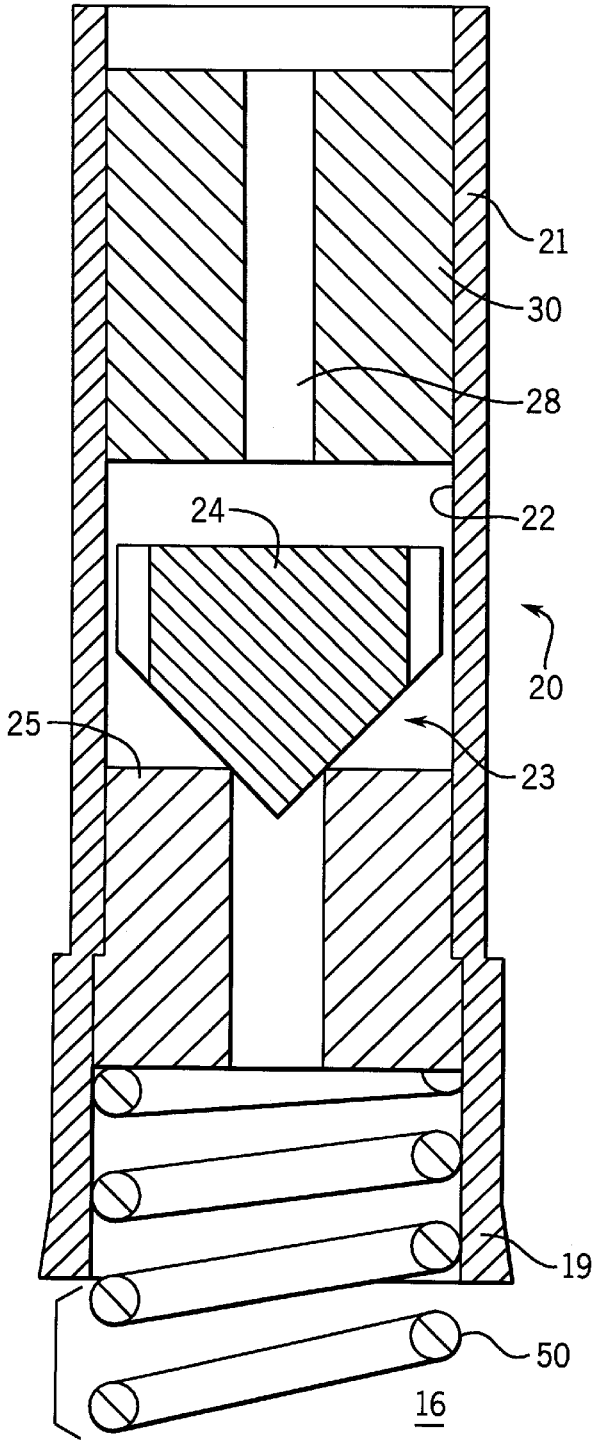
FIG. 3 is an axial section view of a valve mechanism in the device of FIG. 1.

In accordance with FIG. 3, the valve 23 is arranged with its closing surface areas within the piston neck 21 and offset outwardly with respect to the piston 19. The valve element 24 is slidingly guided on the inner circumference 22 of the passage shank 21 and provides longitudinal passages which may be formed by grooves in the outer circumference of the valve element 24. The valve element 25 is located on the inner side of the valve element 24 and is inserted in the integral piston component 19, 21 or configured integrally therewith as well as accommodating a central longitudinal passage passing therethrough, the outer width of the outer end forming its valve seat. On the outer side of the valve element 24 facing away from the valve element 25 a component 30 is located having ferromagnetic properties, which repels the valve element 24 in the direction of the closed position. The component 30 is secured and firmly seated on the neck 21 by circumferential pressure and the passage 28 passes full-length through the component 30.

If an overpressure is produced by shifting the piston 19 in the space 16, this will act through the longitudinal passage in the valve element 25 on the conical front surface area of the valve element 24, which was moved by the magnetic force to the closed position. When the pressure force exceeds the magnetic force, the valve element 24 is lifted in the direction of the component 30 outwardly from the valve seat and the medium flows in the following sequence from the valve element: along the conical front surface area of the valve element 24, through the longitudinal passages thereof, into the flared space between the elements 24, 30, into the passage 28 and from there, without interruption by valves, up to the medium orifice, from which it is totally released from the discharge device 1. The passage 28 is substantially narrower than the space between the elements 24, 30. The valve element 24 is, like the sleeve-shaped component 30, produced throughout exclusively from a ferromagnetic material. Between the two elements 24, 30 no shielding or the like whatsoever is provided which could possibly weaken the effect of the magnetic force. In the open position too, the element 24 is spaced away from the element 30 by magnetic force.

Figure 4:
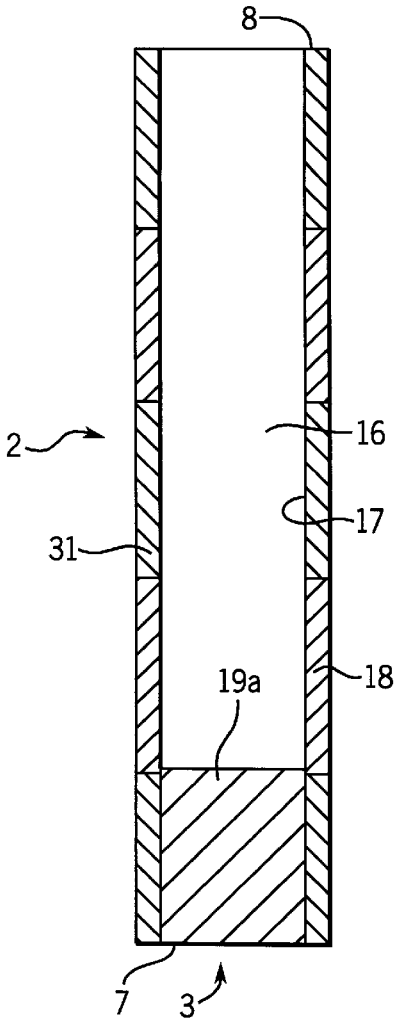
FIG. 4 is a detail sectional view of a magnet drive for medium discharge.
Figure 5:
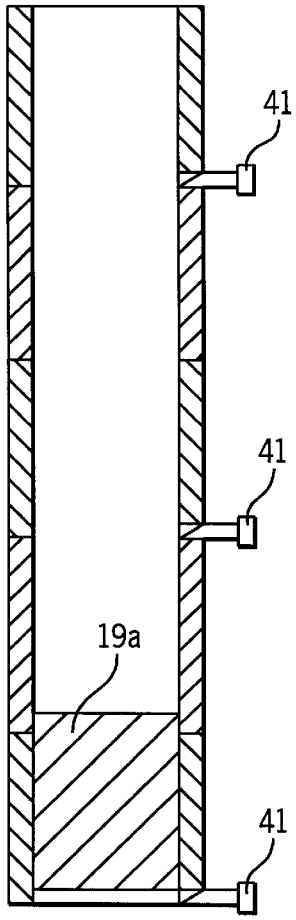
FIG. 5 is a detail sectional view showing a variation of the drive means in accordance with FIG. 4.

The configuration as shown in FIG. 1 is more particularly suited for so-called disposable discharge devices, in which the piston 19 executes no suction or return stroke, but instead merely requires movement in one direction, with the entirety of the medium to be discharged being stored in the space 16. Along the runway 17 spaced portions or components 31 having ferromagnetic properties of the same or differing field strengths may be provided, between which, portions roughly the same in length are provided with no ferromagnetic properties. All portions may be formed directly by the integral shell 18 and may extend up to the running surface area 17. In the starting position as shown in FIG. 4, the piston 19*a* is located in position by a portion 31. When the piston 19*a* is then moved slightly outward in the stroke direction by manual actuation, the piston 19*a* is repelled by this portion and attracted by the next portion. As a result of this activation, the medium is expelled from the space 16 in the direction of the medium orifice. In this arrangement the piston 19*a* may pass by several portions 31 in one movement or be relocated in a further starting position by the subsequent portion 31 in each case, from which it is then released for the next step in the stroke in a way as already described. One such arrangement is evident from FIG. 5.

Figure 6:
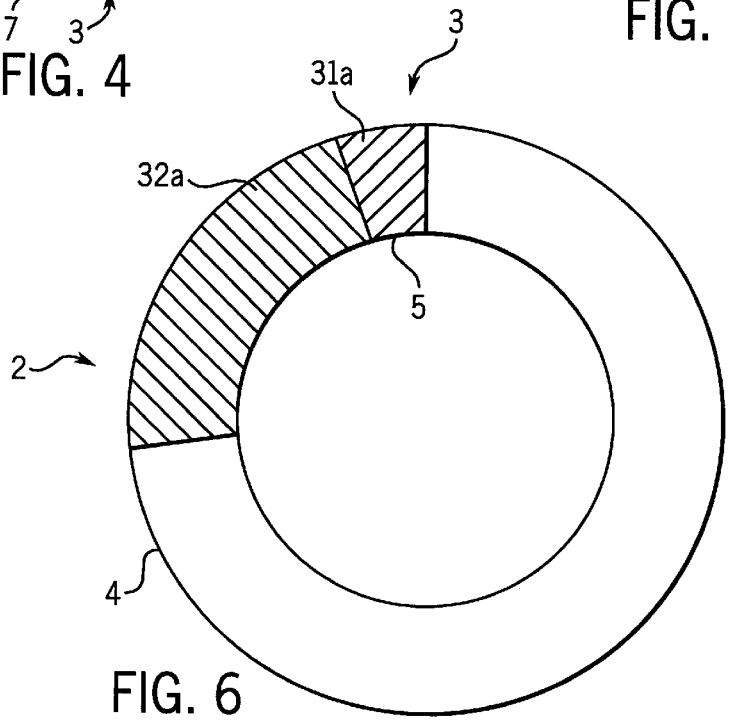
FIG. 6 is a transverse sectional view showing an embodiment for rotational positional location.

As evident from FIG. 6, two units or components 31*a*, 32*a* are mutually rotatable and are located in one or more positions of angular rotation with respect to each other, the two components 31*a*, 32*a* having ferromagnetic properties. In these positions, the two components 31*a*, 32*a* may be in contact with each other and pretensioned by the magnetic force when facing each other with opposite poles. The magnetic components 31*a*, 32*a* have the shape of annular segments and each of the magnetic components 31*a*, 32*a* is firmly seated on one of the base bodies 4, 5 or the like. The two bodies 4, 5 may be manually and mutually rotated against the magnetic retaining force of the components 31*a*, 32*a* and then e.g. moved axially in counter directions implement the discharge stroke, as a result of further movement being positively prevented by abutment of components 31*a*, 32*a*.

In accordance with FIG. 7 the valve 23*b* is located with its closing surface areas outside of the piston neck 21*b* in the pressure space which is flared with respect to the latter and which integrally adjoins the inner end. The valve element 24*b* is plate-shaped constant in thickness throughout so that one or more closing surfaces areas may be flat throughout. Whilst in accordance with FIG. 3 the valve element 25 does not consist of a ferromagnetic material, but of another plastics material, the valve element 24*b* has in accordance with FIG. 7 ferromagnetic properties and its poles are oriented so that it urges the valve element 24*b* to the closed position. The element 25*b* which is inserted in the pressure space is firmly seated by being pressed into place and may protrude beyond the inner end of the piston 19*b* into the shell 18*b* adjacent the space 16*b*. The longitudinal passage in element 25*b* is constructed with respect to the space 16*b* without being guided sealingly on the runway 17*b*. Between the non-grooved outer circumference of the valve element 24*b* and the inner circumference of the pressure space an annularly transverse passage is free for the medium. In the opening position the valve element 24*b* may abut against counter-stops of the piston component 20*b* so that the conduit path into the passage 22*b* remains free. As soon as the pressure in the space 16*b* drops, the valve element 24*b* instantly recloses the valve 23*b* due to the magnetic force. The valve element 24*b* has no passages passing through it.

The inlet valve 13*b* in accordance with FIG. 7 is configured similar to the valve described on the basis of FIG. 3. The flat ring-shaped component 33*b* having ferromagnetic properties is inserted and firmly seated by being pressed into place and is axially defined by abutment with the inner circumference of the shell 18*b*. This component 33*b* urges the valve element inwards to the closed position due to it being offset outwardly with respect to the element 14*b* and the elements 14*b*, 33*b* having the same polarity facing each other. On the return stroke of the piston unit 20*b* the space 16*b* is enlarged, causing a vacuum to be generated in the space 16*b* and urging the element 14*b* in the direction of the open position or the component 33*b* until it lifts from the valve element 15*b*. As a result of this, medium flows from the reservoir through the end 7*b* and the inlet 9*b* along the outer circumference of the element 14*b* into the space between the elements 14*b*, 33*b* through the central annular opening of the element 33*b* so that the space 16*b* is completely filled with medium. At the end of the return stroke the valve 13*b* automatically recloses due to the magnetic force. On the next subsequent working stroke, the medium is displaced in the way that has already been described with respect to the opening of the valve 23*b*.

In accordance with FIG. 3, for resetting the units 2, 3 in the starting position, a mechanical spring 50, for example a coil or pressure spring, may be provided which is supported by its inner end with respect to the housing 6, for example at component 33*b* in FIG. 7, and by its outer end with respect to the base body 5, for example at valve element 25 or within the piston component 19, 21 pretensioned. Instead of spring force, the reset movement in FIG. 7 may also be urged by magnetic force. For this purpose, two magnets facing each other by the same magnetic poles or components of ferromagnetic material may be provided which may be formed directly by the elements 25*b*, 33*b*. In the actuated position the elements 25*b*, 33*b* may abut against each other or remain spaced away from each other.

In accordance with FIG. 8, the element 25*c* is arranged complete within the widest shell of the piston 19*c*.

Like the FIGS. 3, 7, FIG. 9 shows differential pressure valves 13*d*, 23*d* of which the inlet valve 13*d* is configured similar to those in accordance with FIG. 7. In this case the valve element 24*d* executes its opening movement inwardly and opposite to that shown in FIG. 3. The component 34*d* having ferromagnetic properties or the effective pole thereof is located axially with respect to the valve element 24*d* that it freely protrudes into the space 16*d*. The two elements 24*d*, 34*d* form an inherently closed piston/cylinder unit including a variable volume dry or pressure space 48*d* which is always closed and free of medium, this space 48*d* being defined by the two pole sides of the two magnetic components 24*d*, 34*d*. The valve element 24*d* comprises a flared piston collar which is shiftably guided in a dish-shaped depression in the outer face side of the component 24*d* and is sealed off from the gas pressure in the dry space. By being pressing into place or the like, the component 34*d* engages and is firmly seated in the inner circumference of the piston cuff 19*d* with which it defines longitudinal passages which continually connect the space 16*d* to the annular space in the piston cuff 19*d*.

When the pressure of the medium increases in this annular space, as in the space 16*d*, then this pressure acts on the associated front surface area of the piston of the valve element 24*d* so that the latter is shifted inwardly against the cited gas pressure or against the repelling magnetic force with respect to the components 19*d*, 34*d*, causing valve 23*d* to be opened. The valve element 25*d* is configured integrally with the piston component 19*d*, 21*d* and its closing surface area is formed by the annular definition of the inner end of the passage 22*d*. In the course of the working or discharge stroke, the inner end of the component 34*d* plunges into the component 33*d* or into a sleeve-shaped portion having ferromagnetic properties and adjoining the latter, which portion may be configured separately from the component 33*d* or integrally therewith. This portion of component 33*d* has a greater inner width, closely adapted to the outer circumference of the component 34*d*. As a result of this, the resetting force described on the basis of FIG. 7 for the units 2, 3 is substantially increased.

Figure 10:
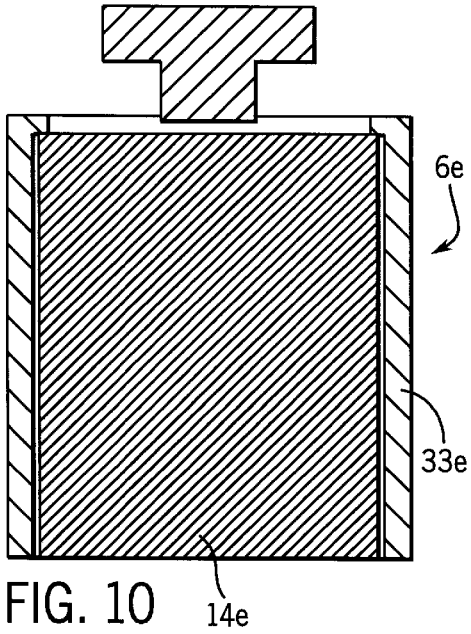
FIG. 10 is a detail sectional view of a second embodiment of an inlet valve seen in FIGS. 7 and 9.
Figure 11:
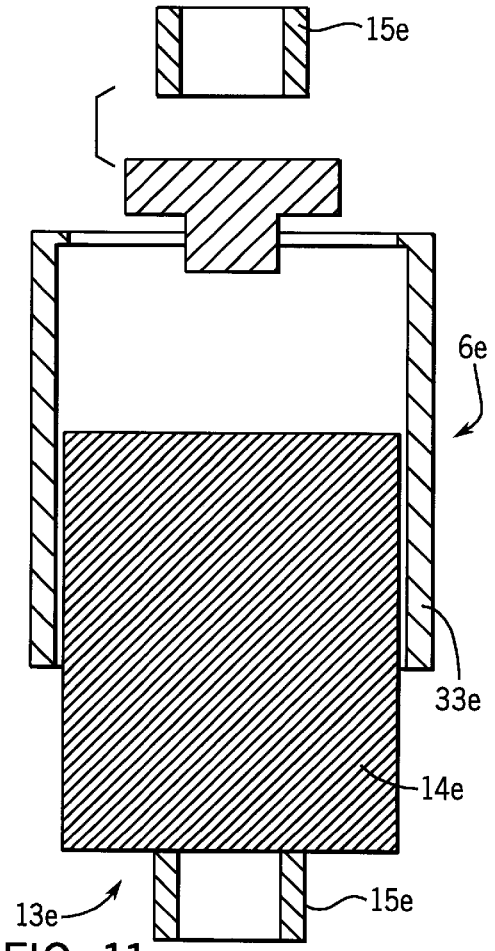
FIG. 11 shows the inlet valve in accordance with FIG. 10 in its activated closed condition.

The manual actuation in accordance with the invention may also be provided, as shown in FIGS. 10 and 11, so that two components 14*e*, 33*e* having ferromagnetic properties are positively located and may abut in a starting position as a result of magnetic force. If one of these components 14*e*, 33*e* is moved a short distance from its starting position by a mechanical follower or the like, then the magnetic latch of the starting position is released and this component is translated totally into its second end position in which it likewise may be limited by abutment. The movable component may be a valve element 14*e* of an arbitrary valve which in an end position, or the starting position, may abut directly against the other component 33*e* and in the other end position may abut against the valve element 15*e* which is stationary with respect to said component 33*e* to thereby close the corresponding valve 13*e*. The follower may be located within the housing 6*e* and act for example on the front surface area of the component 14*e* facing away from the stop 15*e*. In this case, the component 33*e* exhibiting ferromagnetic properties is configured as a thin-walled sleeve which may be inserted and firmly seated in the inner circumference of the shell 18*e* and expediently comprises, protruding beyond its inner circumference, a ring collar against which the component 14*e* abuts in the starting position. In the starting position, the component 14*e* is located completely within the component 33*e* and protrudes in the other end position beyond the corresponding end of this component 33*e* by part of its length.

Figure 12:
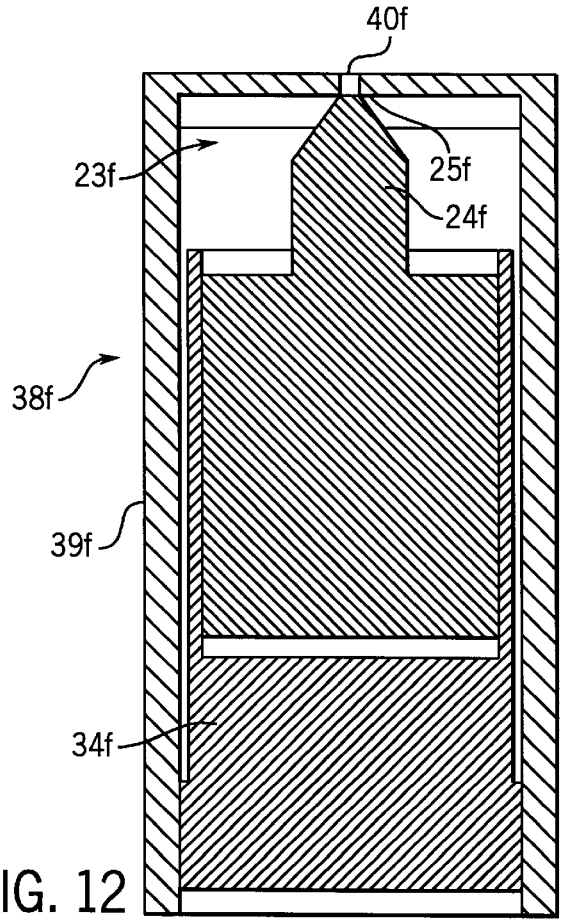
FIG. 12 is an axial section view of another embodiment of a medium valve closure.

In accordance with FIG. 12, the closure 23*f* is spaced away from the piston unit directly at the medium orifice 40*f* which is formed by the outer end of a nozzle passage passing through a wall, such as a face wall. The inner end of this nozzle passage is closed off by the closure element 24*f* and the wall forms the valve element 25*f*. Similar to the arrangement of FIG. 8, the component 34*f* is configured to be dish-shaped so that the valve element 24*f* is able to engage the latter by means of a piston portion and form a dry space, the components 34*f*, 24*f* being translated into the open position by the pressure of the medium. The piston collar of the valve element 24*f* is always located completely within the dish-shaped opening and its closing direction is the same as the direction of flow in the nozzle passage.

Figure 13:
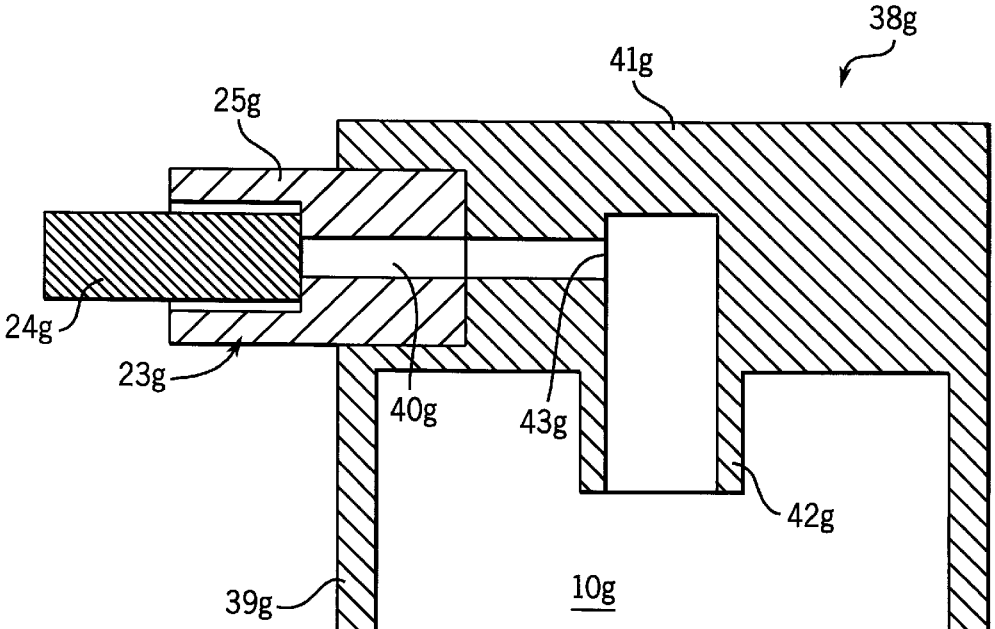
FIG. 13 is a detail section view of a further embodiment of a medium closure.

In accordance with FIG. 1, the discharge head 38 is formed with a port 39 located on the axis 10, the head 38 being continuously tapered in the direction of its free end, in the end surface area of said port 39, a discharge nozzle 40 is located, said port 39 being suitable for introduction into a body cavity such as a nasal cavity. The port 39, which may also connect to the base body 5, may also have a constant width throughout, as shown in FIG. 12, and in this case receives in its free end the valve arrangement 24*f*, 34*f*. In accordance with FIG. 13, the discharge head 38*g* is formed by a cap from which the medium orifice 40*g* emerges transversely to axis 10 oriented at the outer circumference. The medium orifice 40*g* is in this case formed by a sleeve-shaped component 25*g*, not represented in more detail, which receives in its interior the components 24*g*, 35*g* oriented transversely to the axis 10 and, for example, may be configured the same as the port described on the basis of FIG. 12. The closing direction of the valve element 24*g* is located in this case, similar to the situation as shown in FIG. 3, contrary to the direction of flow through the valve 23*g*. In this case, for receiving the rod-shaped valve element 24*g* the valve element 25*g* comprises a dish-shaped opening so that the closing surfaces areas are located with the valve element 25*g* spaced away from the two ends thereof. Both valve elements 24*g*, 25*g* are formed by components having ferromagnetic properties and are urged by their magnetic force in the direction of the closed position.

The head 38*g* may comprise an outermost shell 39*g* which in every position protrudes inwardly beyond the end 8 of the unit 2, 4 or clasps the outer circumference. The outer end surface area of the front wall adjoining the shell 39*g* forms the handle 41*g* of the head 38*g*, the latter forming the base body 5. In the case of FIGS. 1 and 2, the handle 41 is offset inwardly with respect to the outermost end of the head 38 or of the port 39 and protrudes on both sides beyond the port 39.

In each case the head 38 comprises, in its interior, a noncontacting protruding, sleeve-shaped shank 19*b*, 19*c*, 19*d*, 42*g* as a connecting member with which the outer end of the pressure space of the piston unit 20*b*, 20*c*, 20*d*, for example, of the piston neck 21*b*, 21*c*, 21*d*, or of the shank 26*h*, in accordance with FIG. 14 is to be connected and firmly seated. In accordance with FIG. 13, a longitudinal passage passes through the shank 42*g*, a transverse passage branching off from the longitudinal passage within the front wall of the head 38*g*, whereby this transverse passage may extend linearly up to the closing surfaces areas of the valve 23*g* and be coaxially located with respect to the medium orifice.

In accordance with FIG. 14, the valve 23*h* is configured as a plunger valve, the valve element 24*h* of which may form at the same time at least part of the piston 19*h*. The valve element 25*h* is formed by the inner end of the passage shank through which only the passage 28*h* passes for part of its length. A transverse passage 27*h* passes through the shell of the latter at the inner end of the passage 28*h*. The outer end or the opening of the passage 27*h*, which is located in the outer circumference of the valve element 25*h*, is sealingly covered in the closed position by the inner circumference of the component 18*h*. When component 19*h*, 24*h* is shifted outwardly relative to component 18*h*, then this opening is free and the passage 28*h* is communicatingly connected to the space 16*h*. In the closed position, the component 19*h*, 25*h* abuts by its inner front surface area against a stop 37*h*, which may be formed by a flared collar at the inner end of the shank. The component 19*h*, 24*h* is urged into this position magnetically by the component 34*h*, the latter being arranged and firmly seated on the component 25*h*, 26*h*, 37*h*. By being pressed into place, the flat ring-shaped component 34*h* is arranged and firmly seated on the outer circumference of the shank 26*h*, which has a constant width throughout up to the stop 37*h*. The component 34*h* may abut against the cover 29*h* through its side facing away from the component 19*h*, 24*h* in the starting position of the units 2, 3. If the pressure in the space 16*h* increases due to shifting of the piston unit 20*h*, then this pressure acts on the inner piston front surface area and contrary to the resetting force between the components 24*h*, 34*h* until, when this force is overcome, the component 19*h*, 24*h* is shifted against the component 34*h* and the valve 23*h* is opened. As soon as this pressure drops correspondingly the valve 23*h* recloses due to the magnetic force.

Figure 15:
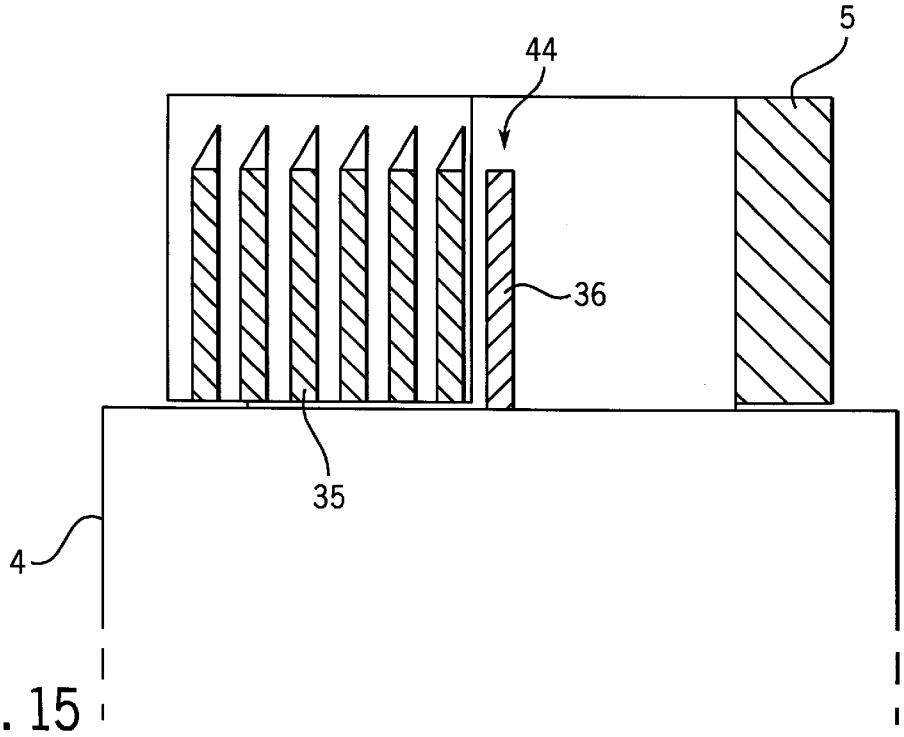
FIG. 15 is a detail section view of a further embodiment of a positioning means.

In accordance with FIG. 15, a sensing and counting means may be provided which includes two positioning members incrementally mutually switchable and, where appropriate, an indicator which renders a symbol visible corresponding to the respective mutual space. For example, a positioning device may incrementally mutually advance the positioning members by a further switching increment for each working or return stroke so that the number of discharge strokes implemented is sensed. One positioning member each is provided on each of the base bodies 4, 5 either firmly seated or integrally connected to the latter or movable with respect thereto for implementing the switching movement. The switching movement is expediently a rotary movement about the axis 10. In FIG. 15 an actuated end position of the sensing means 44 is illustrated in which the actuating cam 36 of the one switching or positioning member is located laterally adjacent to the actuating cam 35 of the other positioning member. When the cam 36 on the return stroke is moved and turned outwardly or upwards, it produces on the next working stroke the gap between two adjacent switching cams 35. The cams 35, 36 are components having ferromagnetic properties so that e.g. in the actuated end position of the stroke of the discharge device, the component 36 sticks to a component 35, to thereby locate the other in position without a spring-type latching mechanism being necessary for this purpose. From this position, the sensing means 44 or the units 2, 3 can then be retranslated into their other end position by a correspondingly large manual force being applied. The components 35, 36 may also ensure in every starting position, however, that by magnetic force a rotary clearance between the positioning members is avoided. Furthermore, in each starting position the magnetic force can urge the cam 36 with the associated positioning member into the next starting position and thus affect incremental switching advancement, even when no mutual mechanical drive connection exists between the positioning members so that a mechanical incremental sensing means is not needed.

In accordance with the FIGS. 7 to 9, the discharge device 1 may also comprise a valve 45*d* in the vicinity of the end 8*d* and outside of, as well as separate from, the pressure space 16*d*, this valve serving more particularly to vent the reservoir vessel so that no vacuum materializes therein due to the increasing drainage thereof. The vent valve comprises a valve element 46*d*, movable with the piston unit 20*d*, and a valve element 47*d*, which is firmly seated with respect to the base body 4*d*, whereby said valve element 47*d* may be formed by the end of a collar of the cover 8*d*, protruding from the end 8*d* into the shell 18*d* and guiding the shank 21*d* or 26*d* with radial clearance so that the guide gap permits the passage of the surrounding air. The valve element 46*d* may be formed by the piston component 19*d*, 21*d* or the conically stepped transition between the piston shell 19*d* and the neck 21*d*, the outer circumference of the latter forming the closing surface area of the valve 45*d*, this closing surface area like the other closing surface area being located on the side of the piston 19*d* in a dry space facing away from the space 16*d*. An opening passes transversely through the shell 18*d* in the region of this dry space, this opening communicatingly connecting the reservoir interior to the dry space at all times. In the starting position, the valve 45*d* is closed and, on the start of the working stroke, it opens due to the valve element 46*d* lifting off from the valve element 47*d*. As a result of this, the reservoir space is then communicatingly connected to the outer atmosphere via the aforementioned guide gap. In accordance with FIG. 14, the valve element 46*d* may be formed by the component 34*d* or provided at outer side or the like facing away from space 16*d*.

In the embodiment in accordance with FIG. 15, the handles 41 for activating the piston 19 or the actuating members engaging the piston 19 are moved transversely to the axis 10, e.g. through openings in the shell 18.

It will be appreciated that all features of every embodiment described may be provided analogously in the case of a single discharge device, this being the reason why all passages of the description apply accordingly to all embodiments. Each of the components having ferromagnetic properties is configured expediently as a permanent magnet, the corresponding component comprising an homogenous grain structure throughout or is configured integrally. All properties and effects may be provided precisely as described or merely roughly or substantially as described or even greatly departing therefrom, depending on the demands the discharge device is required to satisfy. The valves 13, 23, 45, as well as the piston units 20, and all ferromagnetic components too, may be interchanged analogously as required. Furthermore, each of the features described may also be omitted.

We claim:

1. A dispenser for discharging media comprising:

first and second dispenser units (2, 3) including at least one base body (4, 5);

a discharge actuator including a handle (41) for manually pressurizing the media by manually directly displacing said first dispenser unit (2) with respect to said second dispenser unit (3), and a medium space including a pump chamber (16), medium boundaries (17) and a medium outlet (40), wherein said dispenser (1) includes at least one valve component including a ferromagnetic material for positional control of said valve component.

2. The dispenser according to claim 1 and further including a manually operable media pump, wherein a magnetic energy store defining a magnetic field and two magnetic poles emitting a magnetic force is provided.

3. The dispenser according to claim 2 and further including setting means, wherein said at least one component includes first and second components defining first and second said magnetic fields, said magnetic poles of said magnetic fields including a first repelling pole of said first magnetic field and a second repelling pole of said second magnetic field, said first repelling pole opposing said second repelling pole, thereby providing means for magnetically repelling said first component away from said second component, said first component being stationary with respect to said second dispenser unit (3) and said second component being displaceable by said magnetic force with respect to both said first and second dispenser units (2, 3), said second dispenser unit (3) including said medium outlet (40).

4. The dispenser according to claim 1, wherein said at least one valve component includes first and second solid components (32, 31) both including said ferromagnetic material and being displaceable upon magnetic action, said components bounding said pump chamber (16).

5. The dispenser according to claim 1, wherein said at least one valve component is a moveable member (24) displaceably guided on at least one of said base body (4, 5) over a motion path, said motion path including first and second path ends stop-limited by remote stops including said ferromagnetic material.

6. The dispenser according to claim 1, wherein said at least one valve component includes said medium boundaries internally traversing said component.

7. The dispenser according to claim 1, wherein said valve component defines a valve element (14, 24, 25, 46) of a control valve (13, 23, 45) including a vent valve, said component directly providing a valve seat face of said vent valve.

8. The dispenser according to claim 7, wherein said control valve (13, 23, 45) includes at least one of a stop-limited valve, and a slide valve.

9. The dispenser according to claim 1, wherein said valve component includes a manually operable thrust piston for pressurizing the media by displacing said thrust piston inside said pump chamber (16).

10. The dispenser according to claim 9, wherein said thrust piston includes a piston lip enveloping said component.

11. The dispenser according to claim 1, wherein said component (19, 33; 24, 25, 34) includes surfaces including an outermost external circumference, an innermost internal circumference, and at least one end face, at least one of said surfaces directly engaging at least one of said dispenser units (2, 3), said innermost internal circumference including said medium boundaries.

12. The dispenser according to claim 1, wherein said medium spaces include a flow duct provided by a depression in a circumferential face, said component including said depression.

13. The dispenser according to claim 1, wherein said valve component is a cast molded component including magnetic powder and a plastic binder, said magnetic powder being densely distributed within said plastic binder, said magnetic powder volumetrically exceeding said plastic binder by at least three to five times.

14. A dispenser for discharging media comprising:

first and second dispenser units (2, 3) including at least one base body (4, 5);

a discharge actuator for actuating the discharge of the media by displacing said first dispenser unit (2) with respect to said second dispenser unit (3);

a medium space (16) including medium boundaries (17) and a medium outlet (40), wherein said dispenser (1) includes at least one component including a ferromagnetic material; and further including a media pump, wherein said media pump is a valve-controlled thrust piston pump including a pump cylinder and a pump piston unit (20) displaceable within said pump cylinder.

15. The dispenser according to claim 14, wherein said piston unit (20) includes said component (24, 25, 34).

16. The dispenser according to claim 14, wherein said piston unit (20) includes a hollow piston jacket (19), said component (24) engaging inside said piston jacket (19), said component being displaceable commonly with said piston unit (20) and with respect to said piston jacket (19).

17. A dispenser for discharging media comprising:

first and second dispenser units (2, 3) including at least one base body (4, 5);

a discharge actuator for actuating the discharge of the media by displacing said first dispenser unit (2) with respect to said second dispenser unit (3);

a medium space (16) including medium boundaries (17) and a medium outlet (40), wherein said dispenser (1) includes at least one component including a ferromagnetic material; and, wherein said component (32, 31) is rigidly fixed to at least one of said base body (4, 5).

18. A dispenser for discharging media comprising:

first and second dispenser units (2, 3) including at least one base body (4, 5);

a discharge actuator for actuating the discharge of the media by displacing said first dispenser unit (2) with respect to said second dispenser unit (3);

a medium space (16) including medium boundaries (17) and a medium outlet (40), wherein said dispenser (1) includes at least one component including a ferromagnetic material; and, wherein said medium boundaries connect to a flow duct for the medium, said medium boundaries being defined by a cavity in said component.

19. A dispenser for discharging media comprising:

first and second dispenser units (2, 3) including at least one base body (4, 5):

a discharge actuator for actuating the discharge of the media by displacing said first dispenser unit (2) with respect to said second dispenser unit (3);

a medium space (16) including medium boundaries (17) and a medium outlet (40), wherein said dispenser (1) includes at least one component including a ferromagnetic material; and further including a dry zone permanently free of contact with the media, wherein said component directly bounds said dry zone.

20. The dispenser according to claim 19, wherein said dry zone includes a dry space substantially entirely enveloped by said dispenser (1), said dry space being operationally volumetrically variably bounded.

21. The dispenser according to claim 20, wherein said at least one component includes first and second components (24, 34), said first component (24) displaceably engaging inside said second component (34), said second component (34) including a slide face sealingly receiving said first component (24).

22. A dispenser for discharging media comprising:

first and second dispenser units (2, 3) including at least one base body (4, 5);

a discharge actuator for actuating the discharge of the media by displacing said first dispenser unit (2) with respect to said second dispenser unit (3);

a medium space (16) including medium boundaries (17) and a medium outlet (40). wherein said dispenser (1) includes at least one component including a ferromagnetic material; and, wherein said at least one component includes first, second and third components (14, 24, 33), said first and second components (14, 24, 25) being separately displaceable with respect to said third component (33).

23. The dispenser according to claim 22, wherein said third component defines a first side and a second side remote from said first side, said first component (14) being located on said first side and said second component (24) being located on said second side, said third component (33) being rigidly connected to said first dispenser unit (2) and said second component (24, 25) directly connecting to said second dispenser unit (3).

24. A dispenser for discharging media comprising:

first and second dispenser units (2, 3) including at least one base body (4, 5);

a discharge actuator for actuating the discharge of the media by displacing said first dispenser unit (2) with respect to said second dispenser unit (3);

a medium space (16) including medium boundaries (17) and a medium outlet (40), wherein said dispenser (1) includes at least one component including a ferromagnetic material; and wherein said component (25, 33, 34) is positionally fixed by adhesion including at least one of a pretensioned engagement, and a pinch fit.

25. A dispenser for discharging media comprising:

first and second dispenser units (2, 3) including at least one base body (4, 5);

a discharge actuator for actuating the discharge of the media by displacing said first dispenser unit (2) with respect to said second dispenser unit (3), a medium space (16) including medium boundaries (17) and a medium outlet (40), wherein said dispenser (1) includes at least one component including a ferromagnetic material;

and further including releasable position securing means for positionally securing said first dispenser unit (2) with respect to said second dispenser unit (3), wherein said position securing means include said component (31, 32; 35, 36).

26. The dispenser according to claim 25, wherein said first dispenser unit (2) is pivotable with respect to said second dispenser unit (3) to achieve varying rotary positions, said component (35, 36) being provided for positionally securing said dispenser units (2, 3) in said rotary positions.

27. A dispenser for discharging media comprising:

a discharge actuator including a handle (41) for manually pressurizing the media;

a medium space including a volumetrically variable chamber (16), medium boundaries (17) and a medium outlet (40), and control means including at least one component (30 to 36), said at least one component being a cast molded component including a ferromagnetic powder and a plastic binder, said ferromagnetic powder being distributed within said plastic binder, thereby said component being sterilizable.

* * * * *